United States Patent [19]

Grosby

[11] Patent Number: 4,715,587

[45] Date of Patent: Dec. 29, 1987

[54] SINUOUS BAND AND SEAT SPRING ASSEMBLY

[75] Inventor: Lawton H. Grosby, Lake Bluff, Ill.

[73] Assignee: Morley Furniture Spring Corporation, Lake Bluff, Ill.

[21] Appl. No.: 848,787

[22] Filed: Apr. 7, 1986

[51] Int. Cl.[4] ..... A47C 23/16

[52] U.S. Cl. ..... 267/103; 267/110

[58] Field of Search ..... 5/255; 267/103, 106, 267/107, 109, 110, 111

[56] References Cited

U.S. PATENT DOCUMENTS

| | | | |
|---|---|---|---|
| 3,096,086 | 7/1963 | Krakauer | 267/103 |
| 3,525,514 | 8/1970 | Crosby et al. | 267/10 |
| 3,645,523 | 2/1972 | McMahon et al. | 267/107 |

*Primary Examiner*—Duane A. Reger

*Attorney, Agent, or Firm*—Willian Brinks Olds Hofer Gilson & Lione Ltd.

[57] ABSTRACT

A sinuous spring band assembly and a plurality of seat spring assemblies incorporating the sinuous spring band assembly. Each sinuous spring band assembly has a torsion bend complex at its front end and another torsion bend complex at its back end. The bend complex at the front end is pivotably connected by a link member to the front rail of the seat spring assembly. The bend complex at the back end is pivotably connected by a link member to the back rail of the seat spring assembly. The front end bend complex comprises a pair of downward bends and the front end bend complex comprises a single upward bend.

10 Claims, 3 Drawing Figures

FIG. 1
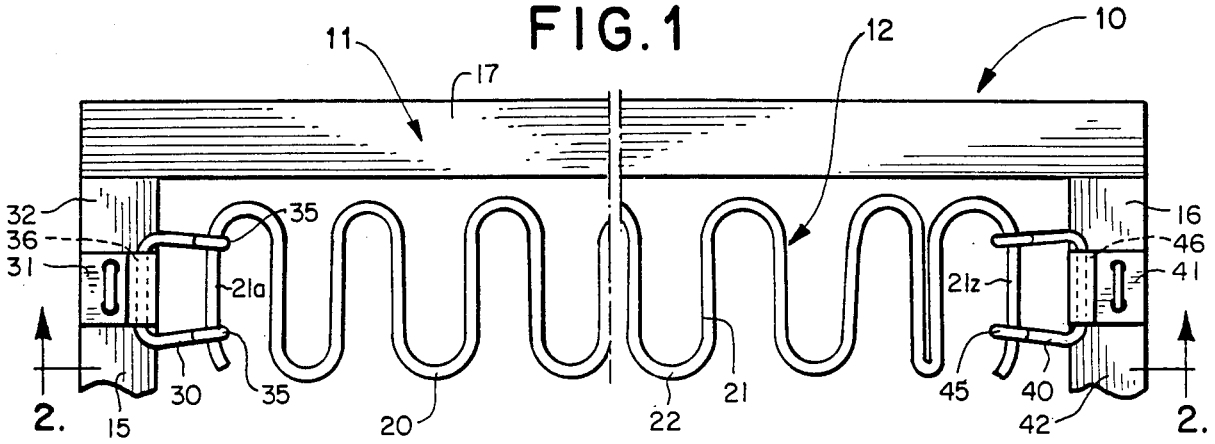
FIG. 2
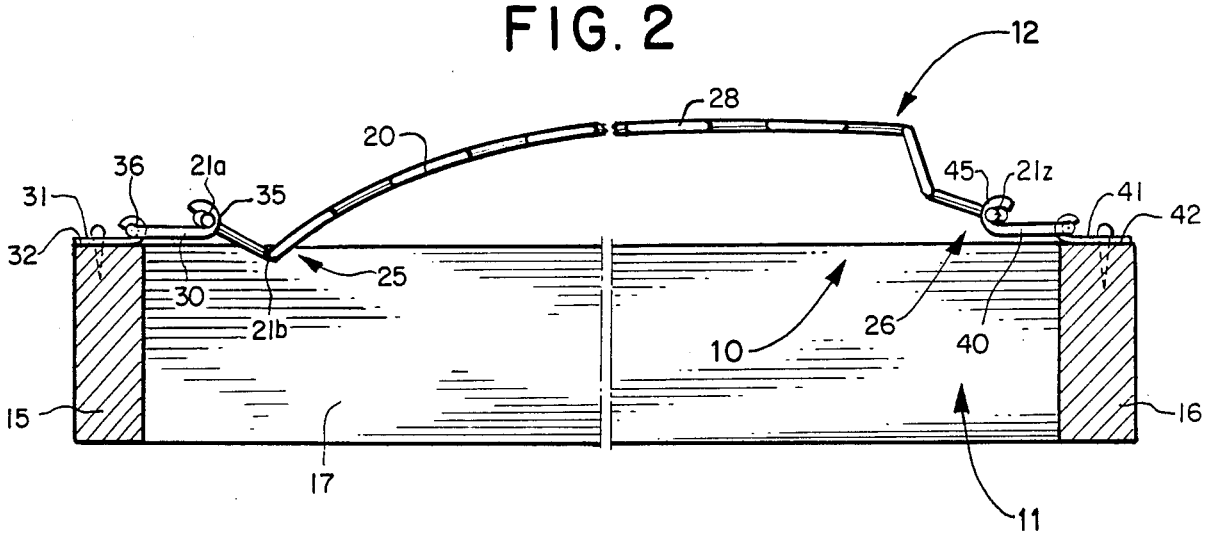
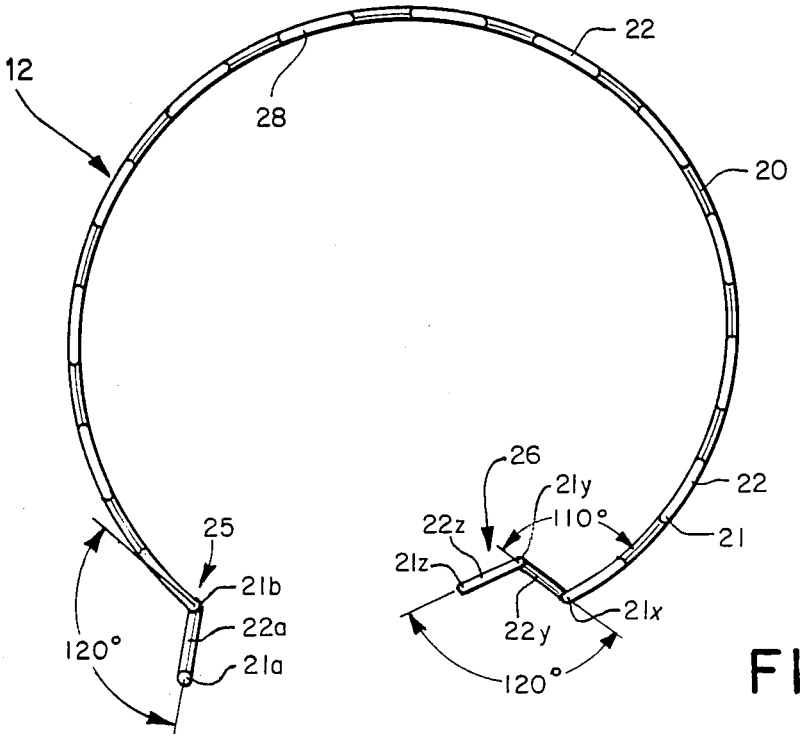
FIG. 3

SINUOUS BAND AND SEAT SPRING ASSEMBLY

FIELD OF THE INVENTION

This invention relates in general to furniture seats. It relates particularly to seat spring assemblies employing spring band assemblies including normally arced sinuous spring bands.

BACKGROUND OF THE INVENTION

The last twenty (20) years have witnessed numerous developments in the use of sinuous springs to replace coil springs. Crosby et al U.S. Pat. Nos. 3,388,904 and 3,525,524 disclose sinuous spring band assemblies which were developed to provide much of the comfort associated with coil spring seating while reducing spring assembly costs dramatically.

Efforts to achieve more sophisticated and improved results with sinuous spring bands have abounded. Morley Furniture Spring Corporation, assignee of the present application and also of the aforementioned patents, has been a leader in this work.

One thing that has eluded Morley and others working in this field is a spring band assembly which precisely proportions pre-compression force along its length, i.e., from back rail to front rail, while providing softness at both front and back rails. Another elusive target has been a seat spring assembly, employing sinuous spring band assemblies, which need employ as few as four band assemblies in a conventional size chair and five band assemblies in a conventional size "wedge" unit.

SUMMARY OF THE INVENTION

An object of the invention is to provide a sinuous spring band assembly for furniture seats wherein proportioned pre-compression and uplift is achieved in the springs from front rail to back rail, together with initial softness at both front and back rails. Another object is to provide a sinuous spring band assembly which is torsioned at each end, yet in which the total stress on the spring band is greatly reduced compared to known torsioned spring assemblies. A further object is to provide a sinuous spring band assembly of the aforedescribed character which permits the use of 20% to 30% fewer spring band assemblies in a single seat frame. Another object is to provide an improved seat spring assembly employing fewer sinuous spring bands than heretofore considered practical. Yet another object is to provide an improved furniture seat spring assembly for horizontal frame rails furniture, e.g. incliners.

The foregoing and other objects of the inventions are realized by providing a sinuous spring band assembly including a normally arced sinuous spring band. The band is regular loop sinuous. It has a torsion bend complex at its front end and at its back end.

The torsion bend complex at its back end comprises an inward bend, from the bands relaxed, approximately circular configuration, of one or two semi-circular wire segments at the second or third linear wire segment. The inward bend is at the third linear segment and creates an internal angle of 110° with a tangent to the band's unstressed arc. The first linear wire segment and its adjacent arcuate wire segment, forming what amounts to a tail portion, are then bent outwardly from the radially inward extending band portion about the second linear wire segment to a position where an internal angle of 120° is formed between the tail portion and the radially extending portion.

The torsion bend complex at its front end comprises an outward bend of one arcuate wire segment at the second linear wire segment. This front bend portion defines an internal angle of 120° with a tangent to the band's unstressed arc.

When extended between the frame rails of a furniture seat, the front and back torsion bend complexes are pivotably connected to corresponding rails. The back bend complex is connected to the back rail directly through the tail portion, through a generally horizontal link member. At the front rail, interposed between the rail and the fowardmost linear wire segment, is another generally horizontal link member.

Adjacent the front rail the band extends well below the top of the rail before bending up to its connection with the rail. This produces a cushion support deck which avoids cushion gap at the front rail. It also assures a desirable slight forward inclination of the support for the seated subject. In the case of horizontal rail furniture this configuration also permits attachment to the front rail near the front of the rail while avoiding interference between the band and the front rail during operation.

The band configuration of the present invention also provides other advantages when extended between the frame rails. As is well known, relaxed sinuous is constructed so that its linear segments extend parallel to each other. It is in this relationship that the band is designed to provide optimum resilient support in the seat spring assembly. When plain sinuous is extended between rails these segments normally diverge. Torqued sinuous heretofore developed has created so much pre-compression as to make them converge. The latter configuration produces better seat resilience than the former but it still detracts somewhat from spring performance. The present invention band configuration results in substantially parallel linear segments after installation, i.e., the band is not stressed, or is only minimally stressed, in the unloaded condition. This results in less strain on the spring band and better retention of spring dynamics.

In operation, when a person sits on a chair embodying a seat spring assembly containing a plurality of these spring band assemblies arranged in parallel relationship, each assembly initially drops down at the back under the buttocks of the person. This movement, or initial drop as it is referred to, is relatively unresisted because of the downward translatory movement of the back end of the spring band afforded by the bend complex tail and/or link member connection. As the thighs of the person being seated reach and exert downward force against the front end of the band, it drops relatively unresisted because of the downward translatory movement of the front end of the band afforded by a combination of the front end bend portion and the link member connection.

When the full weight of the seated person is brought to bear on the spring assembly, the radial bend portion at the back rail rotates in a counter-clockwise direction and exerts horizontal compression force forwardly in the body of the band. This tends to oppose loads seeking to spread the linear wire segments apart and thus serves to maintain uniform upward resilience throughout the drop of the band center under load. The compression force is effective through approximately the back two-thirds of the band.

At the same time, as the person's full weight comes to bear, the outwardly bent front band portion also rotates counterclockwise. Because the front end of the body of the band joins the lower end of this bent portion, however, this rotation exerts horizontal compression force rearwardly in the body of the band. This tends to oppose thigh loads seeking to spread the linear wire segments apart. Upward resilience in the body of the band is maintained rearwardly through the front third of the band.

The cooperating rearward and forward trending compression effects unitize the band's upward resilience. Powerful upward resilience or uplift under the seated person is effected along the entire length of the band, proportioned to the seated subject's weight distribution as it is deposited on the seat spring assembly. This resilience is directed slightly forwardly, as well as upwardly; a desirable feature not found in coil spring assemblies.

It has been found that these spring band assemblies, when using regular loop sinuous (with seven-eighth inch linear wire segment spacing) permit a substantial reduction in the number of band assemblies needed in a seat frame for high quality seating. It is possible, for example, to use four rather than the conventional five spring band assemblies in a normal chair seat, a 20% reduction. It is possible to use five rather than the conventional seven in a conventional "wedge" section, a reduction of nearly 30%.

BRIEF DESCRIPTION OF THE DRAWINGS

The invention, including its construction and method of operation, as well as other objects and advantages thereof, is illustrated more or less diagrammatically in the drawings, in which:

FIG. 1 is a top plan view of a portion of a furniture seat spring assembly illustrating a spring band assembly embodying features of the present invention;

FIG. 2 is a sectional view taken along line 2—2 of FIG. 1; and

FIG. 3 is a side elevational view of the relaxed sinuous spring band employed in the spring band assembly of FIGS. 1 and 2.

DESCRIPTION OF THE PREFERRED EMBODIMENT

Referring now to the drawings, and particularly to FIGS. 1 and 2, a portion of a furniture seat spring assembly embodying features of the present invention is illustrated generally at 10. The assembly 10 includes a seat frame 11 (partially shown) and a plurality of spring band assemblies 12 (only one shown) mounted in the frame.

The frame 11 includes a front rail 15 and a back rail 16 interconnected by side rails 17 (only one shown). The spring band assemblies 12 are mounted between the front rail 15 and the back rail 16. They extend parallel to the side rail 17. As few as four spring band assemblies 12 can be employed in a chair seat.

According to the invention, each spring band assembly 12 comprises a normally arced, "regular" loop, sinuous spring band 20. A band 20 is shown in relaxed form in FIG. 3. It is stretched from this relaxed form to an extended profile, seen in FIG. 2, when it is connected to the front and back rails 15 and 16.

The sinuous spring band 20 is fabricated of hardened spring steel wire by conventional manufacturing techniques. The band 20 comprises a series of normally parallel linear wire segments 21 interconnected by a series of generally semi-circular wire segments 22. In "regular" loop sinuous, the linear wire segments 21 are spaced at seven-eighth's of an inch intervals.

According to the invention, as seen in FIG. 3, a front bend complex 25 is formed in the front end of the band 20 and a back bend complex 26 is formed in the back end of the band. Each bend complex comprises one or more linear wire segments 21 and semi-circular wire segments 22 bent out of the normal arc of the band 20. The unbent body 28 of the band 20 extends between the bend complexes 25 and 26.

The front bend complex 25 comprises the forwardmost linear segment **21*a* in the band 20 and the adjacent, forwardmost, semi-circular segment 22*a*, bent outwardly in a plane about an axis defined by the penultimate linear segment 21*b* at the front end of the band 20. The plane defined by these segments 21*a*, 22*a*, and 21*b* is, after the bending operation, disposed at an interior angle of 130° to the arc of the body 28 of the band 20 or, more precisely, to a tangent to that arc. The segments 21*a*, 22*a*, and 21*b* form an upwardly and forwardly inclined leg which joins the body 28 of the band 20 at its lower end segments 21*b***.

The back bend complex 26 comprises the two rearwardmost linear segments **21*z* and 21*y* in the band 20, with the adjacent two semi-circular segments 22*z* and 22*y*, bent inwardly about an axis defined by the linear segment 21*x*, which is the third linear segment from the back end of the band. The plane formed by the segments 21*x*, 22*y*, and 21*y* is disposed at an interior angle of 110° to the body 28 of the band 20. The segments 21*x*, 22*y*, and 21*y* define an inner leg having an upper end 21*x* and a lower end 21*y***.

As will be seen there are actually two bends in the back bend complex 26. The first, or inner bend, which has been described, is about the linear segment **21*x*. The second, or outer bend, is about the linear segment 21*y*. As a result of the second bend, a plane formed by the segments 21*z*, 22*z*, and 21*y*, defines an interior angle of 120° with the plane of the segments 21*x*, 22*y*, and 21*y*. The segments 21*z*, 22*z*, and 21*y* define an outer leg having an inner end 21*y*, which forms the lower end of the inner leg, and an outer end 21*z*, and their plane extends approximately parallel to the tangent to the body 28 of the band 20**.

Referring again to FIGS. 1 and 2, each band 20 is mounted between the front rail 15 and the back rail 16 of the frame 11 by being stretched out (into the configuration seen in FIG. 2) and pivotably connected to corresponding rails by its forwardmost linear wire segment **21*a* and its rearwardmost linear wire segment 21*z*. A swing anchor 30 connects the wire segment 21*a* to a conventional EK clip 31 stapled to the top surface 32 of the rail 15. Another swing anchor 40 connects the wire segment 21*z* to an EK clip 41 stapled to the top surface 42 of the rail 16**.

The swing anchors 30 and 40 are preferably constructed in the manner illustrated in FIG. 1 of Crosby U.S. Pat. No. 3,790,149. The end clips 35 of the anchor 30 pivotably seat on the linear wire segment **21*a* while its base leg 36 is pivotably seated in the EK clip 31. In turn, the end clips 45 of the anchor 40 pivotably seat on the linear wire segment 21*z* while its base leg 46 is pivotably seated in the EK clip 41**.

With the band 20 mounted in this way the back end of the body 28 of the band, at the linear segment **21*x*, is disposed above the top surface 42 of the back rail 16 by a distance approximately equal to the distance between the linear segments 21***x* and 21*y*. At the same time, the front end of the body 28 of the band 20, at the linear segment 21*b*, is disposed below the top surface 32 of the front rail 15 by a distance approximately equal to one-half the distance between the linear segments 21*a* and 21*b*.

With the spring band assemblies 12 at rest, i.e., with no one seated on the furniture seat in which it is incorporated, the rear end bend complexes 26 are effective to create a forward trending compression in the bodies 28 of each band 20. This is achieved through a torque effect created by the tendency of the vertical inner leg in the bend complex 26 to rotate in a counterclockwise (CCW) direction when it is under load. The effect is to compress the body 28 of the band 20 slightly in the direction of the front rail 15, for approximately two-thirds the distance from the back rail 16 to the front rail, and force the linear segments 21 of the stretched band 20 back into parallel relationship.

At the same time, the front end bend complex 25 in each band assembly 12 is effective to create a rearward trending compression in the body 28 of the band 20. This is achieved through a torque effect created by the tendency of the inclined bend complex 25 to rotate in a counterclockwise (CCW) direction also, albeit from bottom inward rather than, as with the front back complex, from the top forward. Rearward compression force induced by the bend complex 25 is only about one-half the forward compression force exerted in the band 20 by the bend complex 26. As a result, these opposite trending forces equalize at a point about one-third of the way back from the front rail 15 to the back rail 16. Nevertheless, the torque effect of the bend complex 25 tends to compress the band rearward in the body of the band 20 to this point and urge the linear segments 21 in that section of the band into parallel relationship.

When someone sits on the seat spring assembly 10, or rather the upholstery and padding which covers it, it is normal for the subject's buttocks to come to rest and press down first in the center of the back two-thirds of the band 20. Initially, this causes the rear end of the band to move downwardly without much distortion because the swing anchor 40 pivots about its connections with the rail 16 and with the linear band segment 21*z*. An "initial softness" in the feel of the seat is the result.

As the swing anchor 40 pivots downwardly, the lower end of the bend complex 26 is pulled outwardly, increasing the torque effect of the inner leg in the complex, and creating greater forward trending compression in the body 28 of the band 20. This increases the resilience of the band in its back two-thirds and creates substantial uplifting force under the subject's buttocks.

Meanwhile, the thighs of the subject are engaging and forcing the forward one-third of the band 20 downwardly. Initial softness is again created, this time by the pivoting of the swing anchor 30 downwardly.

Downward and forward swinging of the inner end of the swing anchor 30 soon pulls the upper end of the bend complex 25 outwardly, however. This increases the torque effect of the bend complex 25, compressing the body 28 of the band 20 rearwardly and creating uplift under the subject's thighs through the forward one-third of the band 20.

The overall effect on a subject being seated is initial softness at the rear followed by a firming and uplift, the firming and uplift at the rear being effected coincidental with an initial softness at the front. The latter initial softness is followed by a stiffening and uplift under the thighs of the subject. All this is accompanied by a slight but noticeable forwardly inclined uplift under the subject, created by the profile of the spring band 20 in place. This profile also accommodates a gapless cushion fit at the front rail 15.

Prior to a subject being seated, the linear wire segments 21 in each band 20 are in parallel, substantially unstressed form. When a subject is seated, the band assemblies 12 provide enormous support for the person being seated, up to 30% more than previously thought possible, as will subsequently be elaborated upon.

While the process and product embodiments described herein are at present considered to be preferred, it is understood that various modifications and improvements may be made therein, and it is intended to cover in the appended claims all such modifications and improvements as fall within the true spirit and scope of the invention.

I claim:

1. A sinuous spring band assembly mounted between the front rail and the back rail of a furniture seat frame, comprising:

(a) a normally arced sinuous spring band stretched out between the front rail and the back rail;

(b) said band being a regular loop sinuous band including a series of generally linear wire segments spaced about seven-eighths of an inch apart and interconnected by a series of generally semi-circular wire segments;

(c) said interconnected wire segments defining a front bend complex in said band, a back bend complex in said band, and a body in sand band extending between said bend complexes;

(d) said back bend complex including a downwardly and rearwardly inclined inner leg having an upper end and a lower end, and an outer leg having an inner end joined to said lower end and an outer end spaced from said inner end, said upper end of said inner leg joining the body of said band;

(e) back rail connecting means including a horizontally elongated member pivotably connected to said outer end of said outer leg and to said back rail;

(f) said front bend complex including an upwardly and forwardly inclined leg having a lower end joining the body of said band an upper end; and (g) front rail connecting means including a horizontally elongated member pivotably connected to said upper end of said front bend complex leg and to said front rail.

2. The sinuous spring band assembly of claim 1 further characterized in that said sinuous spring band, in relaxed from prior to being stretched out, includes:

(a) in said back bend complex an interior angle of about 110° defined between said body and said inner leg, and an interior angle of about 120° defined between said outer leg and said inner leg; and (b) in said front bend complex an interior angle of about 120° defined between said body and said leg.

3. The sinuous spring band assembly of claim 1 further characterized in that:

(a) each of said horizontally elongated members in said rail connecting means includes a base leg pivotably connected to a corresponding rail and converging side legs pivotably connected to a corresponding bend complex.

4. A sinuous spring band assembly mounted between the front rail and the back rail of a furniture seat frame, comprising:

(a) a normally arced sinuous spring band stretched out between the front rail and the back rail;

(b) said band being a sinuous band including a series of generally linear wire segments spaced apart by a series of generally semi-circular wire segments;

(c) said interconnected wire segments defining a front bend complex in said band, a back bend complex in said band, and a body in said band extending between said bend complexes;

(d) said back bend complex including a downwardly and rearwardly inclined inner leg having an upper end and a lower end, and an outer leg having an inner end joined to said lower end and an outer end spaced from said inner end, said upper end of said inner leg joining the body of said band;

(e) back rail connecting means including a link member having a base leg pivotably connected to said back rail and converging side legs which are pivotably connected to said outer end of said outer leg;

(f) said front bend complex including an upwardly and forwardly inclined leg having a lower end joining the body of said band and an upper end; and (g) front rail connecting means including a link member having a base leg pivotably connected to said front rail and converging side legs pivotably connected to said upper end of said front bend complex leg.

5. The sinuous spring band assembly of claim 4 further characterized in that:

(a) said inner leg of said back bend complex includes a single semi-circular wire segment.

6. The sinuous spring band assembly of claim 5 further characterized in that:

(a) said upwardly and forwardly inclined leg of said front bend complex includes a single semicircular wire segment.

7. A sinuous spring band assembly mounted between the front rail and the back rail of a furniture seat frame, comprising:

(a) a normally arced sinuous spring band stretched out between the front rail and the back rail;

(b) said band including a series of generally linear wire segments spaced apart and interconnected by a series of generally semi-circular wire segments;

(c) said interconnected wire segments defining a front bend complex in said band, a back bend complex in said band, and a body in said band extending between said bend complexes;

(d) said back bend complex including a downwardly and rearwardly inclined inner leg having an upper end and a lower end, and an outer leg having an inner end joined to said lower end and an outer end spaced from said inner end, said upper end of said inner leg joining the body of said band;

(e) back rail connecting means including a normally horizontaly link member pivotably connected to said back rail and to said outer end of said outer leg;

(f) said front bend complex including an upwardly and forwardly inclined leg having a lower end joining the body of said band and an upper end; and (g) front rail connecting means connecting said front rail to a linear segment which forms said upper end of said front bend complex leg in a manner which permits said upper end linear segment to move relative to said front rail.

8. The sinuous spring band assembly of claim 7 further characterized in that said sinuous spring band, in relaxed form prior to being stretched out, includes:

(a) in said back bend complex an interior angle of about 110° defined between said body and said inner leg, and an interior angle of about 120° defined between said outer leg and said inner leg; and (b) in said front bend complex an interior angle of about 120° defined between said body and said leg.

9. The sinuous spring band assembly of claim 8 further characterized in that:

(a) said inner leg of said back bend complex includes a single semi-circular wire segment.

10. The sinuous spring band assembly of claim 9 further characterized in that:

(a) said upwardly and forwardly inclined leg of said front bend complex includes a single semi-circular wire segment.

* * * * *

UNITED STATES PATENT AND TRADEMARK OFFICE

CERTIFICATE OF CORRECTION

PATENT NO. : 4,715,587

DATED : Dec. 29, 1987

INVENTOR(S) : Lawton H. Crosby

It is certified that error appears in the above-identified patent and that said Letters Patent is hereby corrected as shown below:

IN THE HEADING OF THE COVER SHEET

Below "United States Patent [19]" please correct the inventor's name by deleting "Grosby" and substituting therefor --Crosby--.

IN THE SECTION ENTITLED "[75] INVENTOR:

Please correct the inventor's name by deleting "Grosby" and substituting therefor --Crosby--.

IN THE SECTION ENTITLED "[56] REFERENCES CITED"

In the Crosby et al. reference No. 3,525,514, please delete "267/10" and substitute therefor --267/110--;

Please create a subheading "FOREIGN PATENT DOCUMENTS" and include the reference --1406726 9/1987 Great Britain ..... 267/103--.

IN THE SUMMARY OF THE INVENTION

In column 2, line 14, please delete "fowardmost" and substitute therefor --forwardmost--.

UNITED STATES PATENT AND TRADEMARK OFFICE

CERTIFICATE OF CORRECTION

PATENT NO. : 4,715,587

DATED : Dec. 29, 1987

INVENTOR(S) : Lawton H. Crosby

It is certified that error appears in the above-identified patent and that said Letters Patent is hereby corrected as shown below:

IN THE CLAIMS

In Claim 1 (column 6, line 35), subparagraph (c), please delete "sand band" and substitute therefor --said band--;

In Claim 1 (column 6, line 48), subparagraph (f), after "said band" insert --and--;

In Claim 2 (column 6, line 55), please delete "relaxed from" and substitute therefor --relaxed form--;

In Claim 6 (column 7, line 41), subparagraph (a), please delete "semicircular" and substitute therefor --semi-circular--;

In Claim 7 (column 8, line 17), subparagraph (e), please delete "horizontaly" and substitute therefor --horizontal--.

Signed and Sealed this

Eighteenth Day of October, 1988

*Attest:*

*Attesting Officer*

DONALD J. QUIGG

*Commissioner of Patents and Trademarks*